US011587539B2

(12) United States Patent
Antere

(10) Patent No.: US 11,587,539 B2
(45) Date of Patent: Feb. 21, 2023

(54) WIND INSTRUMENT SUPPORT APPARATUS

(71) Applicant: Ergobrass Oy, Sipoo (FI)

(72) Inventor: Jouko Antere, Sipoo (FI)

(73) Assignee: Ergobrass Oy, Sipoo (FI)

( * ) Notice: Subject to any disclaimer, the term of this patent is extended or adjusted under 35 U.S.C. 154(b) by 0 days.

(21) Appl. No.: 17/364,922

(22) Filed: Jul. 1, 2021

(65) Prior Publication Data

US 2023/0005456 A1 Jan. 5, 2023

(51) Int. Cl.

| | |
|---|---|
| ***G10D 9/00*** | (2020.01) |
| ***G10G 5/00*** | (2006.01) |
| ***G10D 7/06*** | (2020.01) |

(52) U.S. Cl.

CPC ..... *G10G 5/005* (2013.01); *G10D 7/06* (2013.01); *G10D 9/00* (2013.01)

(58) Field of Classification Search

CPC ..... G10G 5/005; G10G 5/00; G10D 7/06; G10D 9/00

See application file for complete search history.

(56) References Cited

FOREIGN PATENT DOCUMENTS

KR 101407474 B1 * 3/2014 ..... G10G 5/00

* cited by examiner

*Primary Examiner* — Kimberly R Lockett

(74) *Attorney, Agent, or Firm* — Laine IP Oy

(57) ABSTRACT

According to an example aspect of the present invention, there is provided a wind instrument apparatus, comprising: an attachment element configured to attach the apparatus to a wind instrument, a spring structure attached to or comprised by the attachment element, and a support bar. The support bar is partially insertable into the elastic structure and the apparatus comprises a fastening mechanism configured to selectively fasten the support bar in relation to the elastic structure, so that the flexibility of the attachment element is adjustable in relation to the support bar.

6 Claims, 6 Drawing Sheets

WIND INSTRUMENT SUPPORT APPARATUS

FIELD

The present invention relates to supports for wind instruments.

BACKGROUND

Generally, a wind instrument is a wind instrument in which generates sound by vibrating air in a tube by a player blowing into (or over) a mouthpiece. Clarinets, oboes, and English horns are examples of wind instruments.

Supporting the weight of the wind instrument by hand, e.g. by musician's thumb, is burdensome and may cause physical issues and trouble over time. Pain and physical conditions may be caused for musicians over time when the weight of the instrument is on the thumb. Such continued strain is problematic particularly for younger musicians, and may lead to reduced playing time or incorrect playing positions. Breathing and blowing may suffer from inappropriate playing position or undue strain. Neck supports have been developed, but they can reduce the weight only to some extent. Wind instrument supports leaning against floor or chair have also been developed. However, there is a need for improvements in supporting wind instruments, which cause minimal effects or limitations when playing the instrument.

SUMMARY OF THE INVENTION

According to some aspects, there is provided the subject-matter of the independent claims. Some embodiments are defined in the dependent claims.

According to an aspect, there is provided a wind instrument apparatus, comprising: an attachment element configured to attach the apparatus to a wind instrument, a spring structure attached to or comprised by the attachment element, and a support bar. The support bar is partially insertable into the elastic structure and the apparatus comprises a fastening mechanism configured to selectively fasten the support bar in relation to the elastic structure, so that the flexibility of the attachment element is adjustable in relation to the support bar.

EMBODIMENTS

There is now provided a wind instrument support apparatus, which allows further freedom of movement for a user playing a wind instrument attached to the support. This is achieved by an elastic or flexible portion in the support, in some embodiments a spring structure, enabling the user to change the orientation of the wind instrument in relation to a rigid portion of the support, which may be against a chair, floor, further support portion, or musician's leg, for example. For example, the musician may move in various ways, e.g. lean forward, backwards, or sidewards, perform back and forth movement, perform circular movement, etc. The flexibility level is adjustable according to the musician's personal preference. The wind instrument support apparatus may be designed for, and adapted to be attached to, at least one of a clarinet, an oboe, an English horn, a saxophone, a recorder/fipple flute, or an electronic wind instrument (EWI), for example.

Figure 1:
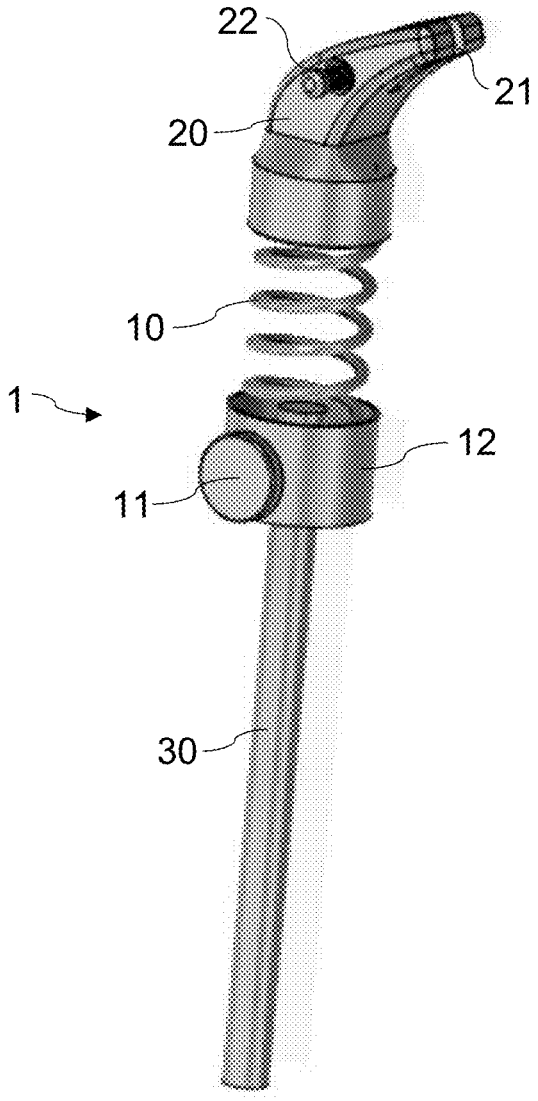
FIG. 1 illustrates an example wind instrument support apparatus according to some embodiments.

FIG. 1 illustrates a wind instrument support apparatus 1. The apparatus 1 comprises an attachment element 20 to attach the apparatus to a wind instrument, a spring structure 10 attached to or comprised by the attachment element, and an elongated support portion or bar 30. The spring structure 10 comprises at least one spring attached to the attachment element 20 directly or via an intermediate element.

The support bar 30 is substantially rigid and partially insertable into the spring structure 10. The apparatus 1 comprises a fastening mechanism to selectively fasten the support bar 30 in relation to the spring structure 10, to selectively adapt the flexibility of the attachment element 20 in relation to the support bar 30 according to the musician's preference. In other words, the musician may, by adjusting the position of the bar in relation to the spring structure, configure or adapt the flexibility of the support apparatus 1.

The spring structure may comprise or be connected to a sleeve 12 via which the bar 30 may be moved into the spring structure. The spring of the spring structure 10 is mounted on the sleeve 12. The sleeve may provide support for fastening the bar in relation to the spring structure. In the present example embodiment, the fastening mechanism comprises a clamping screw 11 arranged in the sleeve 12. The musician may set and secure upper portion of the flexibility of the support apparatus 1 by fastening the bar 30 at a desired position in relation to the spring structure 10 by engaging the clamping screw onto the bar.

Figure 2A:
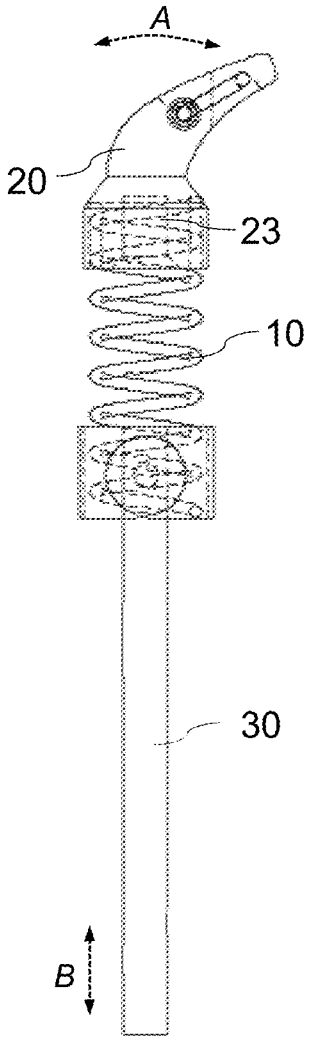
FIGS. 2*a*, 2*b*, and 2*c* illustrates different flexibility settings.
Figure 2B:
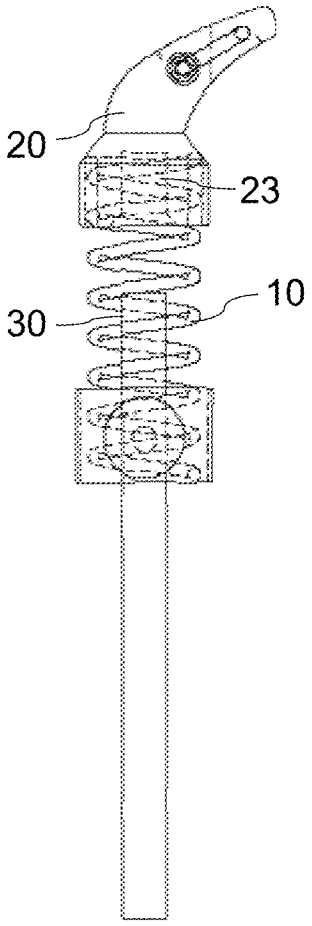
Figure 2C:
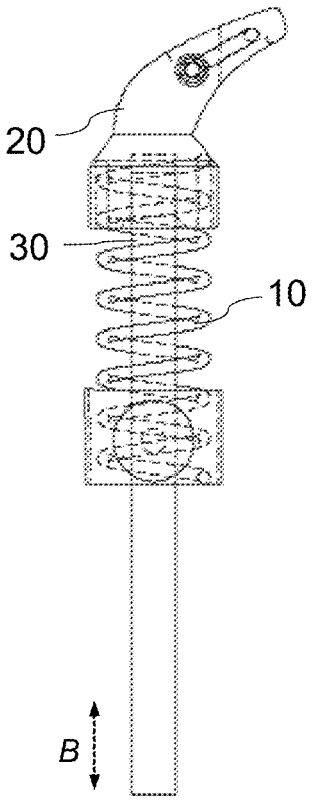

FIGS. 2*a* to 2*c* illustrate examples of different flexibility levels of the support, apparatus 1, achieved by different positions of the bar 30 in relation to the spring structure 10 and the attachment element 20.

In FIG. 2*a* the bar 30 does not prevent movement of the spring structure 10, the spring may bend throughout its complete open area, to provide lateral or horizontal direction movement of the attachment element and the connected instrument (when in playing position) in relation to the bar 30. This represents full flexibility setting of the support apparatus 1, i.e. the support apparatus allows the greatest range of movement (of the attachment element in relation to the bar) when in this setting. The example indicates direction A, which may illustrate a direction of the musician leaning forward or backward when in the playing position and using the wind instrument attached into the element 20.

FIG. 2*b* illustrates middle position of the bar 30 with respect to the spring structure 10, and medium flexibility position. In such a position, in accordance with the laws of physics, the spring structure cannot flex throughout its whole length. Rather, only the portion of the spring structure which is between the end of bar 30 and attachment element 20 may flex. Therefore, in such a position the spring will bend less in both the lateral and transverse directions, as the flexure of the spring is limited by the bar 30. It is understood that the end of the bar 30 may be freely positioned anywhere within the spring structure, which allows for precise setting of the desired flexibility. In other words, the bar 30 may be adjusted in a continuous manner by positioning the end of the bar at any position within the spring structure 10.

The present wind instrument support apparatus 1 facilitates in a beneficial manner that the instrument can better and genuinely move with upper body movement of the musician. The apparatus provides improved freedom of movement without or with reduced restraint or weight. This enables to substantially reduce limiting effect and feeling of the support to the musician in comparison to a conventional support, while still reducing burden on the musician's musculature and facilitating relaxed playing. Hence, improved ergonomics are provided, which reduces the risk of injury due to e.g. long-term repetitive strain.

The attachment element 20 may comprise a channel 23, illustrated by broken line, for receiving the support bar through the spring structure to suppress the flexibility of the attachment element in relation to the support bar. In FIG. 2*c* the bar 30 is inserted into the channel 23 of the attachment element 20. In this position the spring does not bend and the bar in the channel prevents relative movement between the element 20 and the bar. The musician may select this position when no (lateral) flexibility of the support is desired. However, in such a position the support apparatus 1 still has flexibility in the vertical direction, illustrated by arrow B, providing softer support for the instrument.

The at least one spring of the spring structure 10 may be of metal, e.g. steel, or another appropriate material of thickness facilitating to achieve desired flexibility, and capable of maintaining its properties during use of the apparatus 1 supporting the weight of the instrument and continued bending of the instrument in relation to the bar 30. Some examples of spring types are coiled springs, helical springs, cantilever springs, volute springs, and cushion-type springs. Leaf springs may be elliptic, semi-elliptic, parabolic or other types of leaf spring. For example, a coiled spring of steel wire having diameter between 1-3 mm, such as 2 mm, may be applied. The spring may be attached to the attachment element 20 and/or the sleeve 12 by adhesive bonding, soldering, welding, or another suitable joining method.

The bar 30, sleeve 12, and/or the clamping screw 11 may be of steel or plastic, for example. The bar may have diameter between 0.5-1.0 cm, such as 0.6, 0.7, or 0.8 mm, for example. The spring structure 10 may have length (B direction) in the range of 25-75 mm, in some further embodiments between 60-75 mm, such as 70 mm, for example. Outside diameter of the spring structure 10 may be between 12-25 mm, in some embodiments between 15-21 mm, such as 18 mm, for example. The number of coils may be between 5-10, such as 7, for example. The B direction length of the sleeve 12 may be e.g. in the range of 0.5-3 cm. For example, when in the position of FIG. 2*a*, the bar 30 may be around 1 cm inside the sleeve. It will be appreciated that dimensioning of the spring structure, e.g. the steel wire diameter, may be selected based on type and weight of the instrument for which the support is optimized (e.g. an oboe may weight around 0.7-0.8 kg, whereas some saxophones may weight around 1.5 kg.

It will be understood that different lengths of the apparatus and the bar 30 can be used to provide instrument stands adapted for players of different heights or having different playing styles. In some embodiments, the length of apparatus 1 is adjustable, by the length of the bar being adjustable, or by having a further leg portion with adjustable length. A telescopic leg portion or sliding shafts with a twist locking mechanism for selecting a desired length can be utilized.

Figure 3:
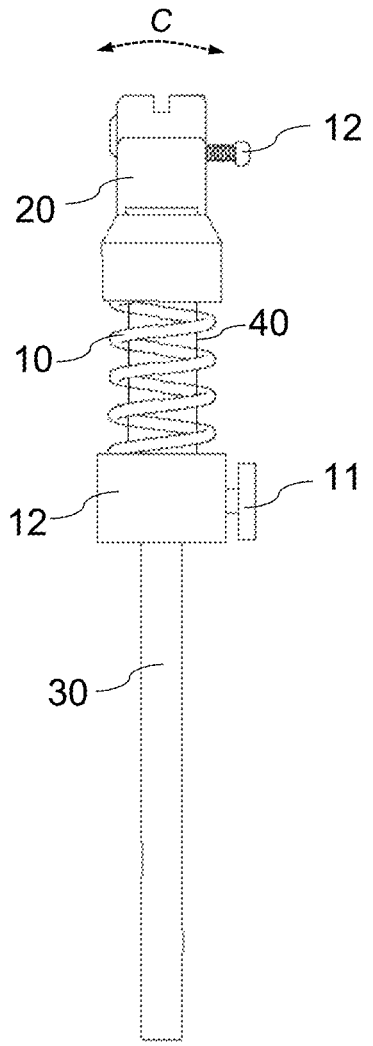
FIG. 3 illustrates another side view of an example wind instrument support apparatus according to some embodiments.

FIG. 3 illustrates another side view of the apparatus 1, indicating also movement direction C, facilitated by the spring structure 10 for the attachment element 20 in relation to the bar 30. This direction may illustrate a direction of the musician leaning sideward back and forth when in the playing position and using the wind instrument attached into the element 20.

The apparatus 1 may further comprise a flexible tube at or within the elastic portion. As illustrated in the example of FIG. 3, such flexible tube 40 may be positioned inside the spring structure 10, and the support bar 30 is movable inside the flexible tube. The tube may thus prevent the bar 30 to directly touch the spring structure, which may cause resonance vibration and/or sound which may be detrimental for the quality of the music being produced by the instrument. The tube may be of plastic, rubber, or another suitable material.

In the example of FIG. 1, the attachment element 20 comprises a slot 21 for receiving a fastener of the instrument, such as a neck support mounting ring of the instrument. A clamping device, and a switch or a push element 22 is arranged to releasably engage the fastener inside the slot 21.

The attachment element 20 can be considered as penguin-shape, but it will be appreciated that various other shapes may be applied. The attachment element may be made of plastic, and the clamping device may comprise steel, for example.

Figure 4A:
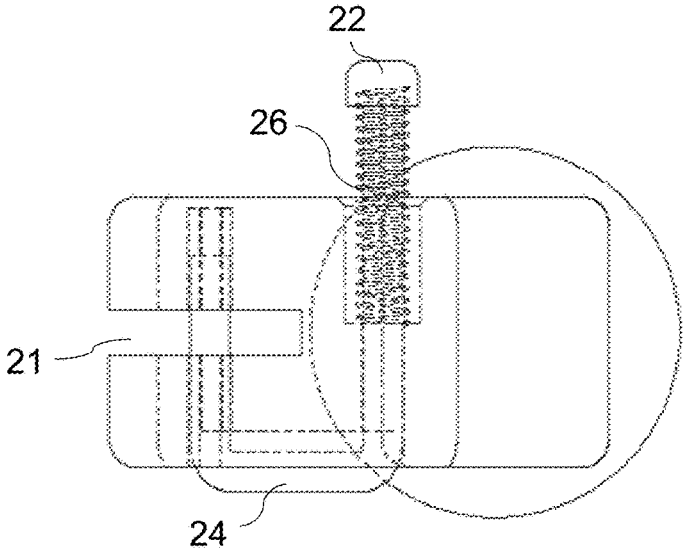
FIGS. 4*a* and 4*b* illustrate an example of a wind instrument attachment element.

FIG. 4*a* illustrates a top view from above the attachment element 20, in a closed position of the clamping device, in which the instrument may be locked into the support apparatus 10. A spring may maintain a locking pin 24, in the present example of U- or J-shape, in a locking slot 25 and occupying the slot 21 when no pushing force is applied to the push element 22.

Figure 4B:
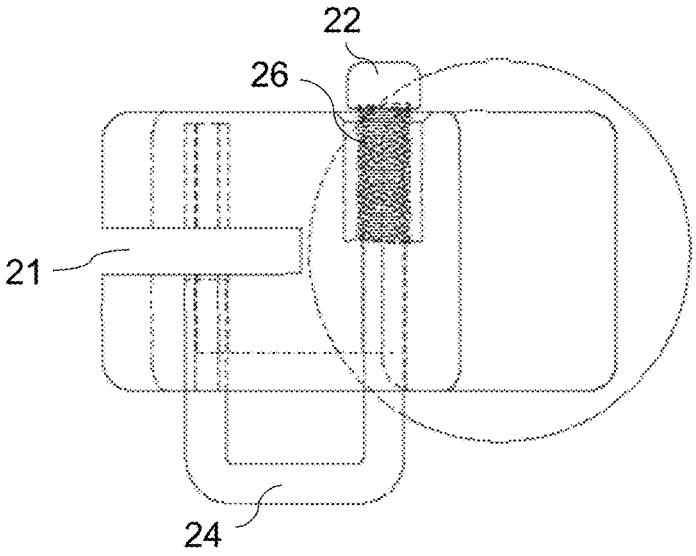

FIG. 4*b* illustrates the clamping device in its open position. Thus, when the musician pushes the push element 22, the pin 24 is removed from the locking slot 25 and further from the slot 21, thereby opening the slot 21 to receive or release the fastener of the instrument. Hence, attachment and detachment is very easy, simply by pushing the button 22. However, it will be appreciated that FIGS. 4*a* and 4*b* illustrated some example options and that various other attachment mechanisms may be applied in the attachment element close to the spring structure 10.

The apparatus 1 may further comprise a fastener to fasten a neck strap or other type of further support (not shown). The fastener may be attached to the sleeve 12 and may comprise a ring, for example. A neck support may be preferred by some musicians, to provide further stability and touch for controlling the instrument. Such further fastener does not affect functioning of the upper spring structure as such.

The apparatus 1 and the bar 30 thereof may further comprise or be connected to a further support unit. The further support unit may form other end of the complete wind instrument support structure and be held against chair or musician leg(s) during a playing position. Various structures are available for the further support unit and for engaging the bar 30 to the further support unit. In an example embodiment, the further support unit comprises a hollow portion into which the other end of the bar 30 is inserted, and a fastening mechanism, e.g. a thumb wheel, to engage the bar to the support unit at desired position. The overall desired height position of the instrument may be thus adjusted by the further support, and the spring structure 10 next to the attachment element 20 and close to the instrument provides the flexibility and freedom of movement for musician at upper portion of the entire support structure. An end portion of rubber of other non-slip, high friction material may be included to enable non-slipping support.

In another example embodiment, the further support unit comprises a (male/female) threaded portion at one end and the bar 30 comprises a (female/male) threaded portion in a hollow portion at the end of the bar 30, which allows the further support unit to be inserted into the end of the bar 30 and fastened therein by tightening the further support unit to the bar 30.

The apparatus may further comprise a further elastic portion, or suspension element, to provide flexibility in vertical direction (illustrated by arrow B in FIGS. 2*a* and 2*c*) during playing of the attached instrument. The suspension element may be arranged in the bar 30 or connected to the bar. In an example embodiment, the suspension element is arranged in the further support unit. For example, the unit may comprise a spring into which the bar 30 may be inserted and fastened. Similar fastening mechanism may be applied as at the other end for adjusting the relation to the spring structure 20, including a sleeve and a clamping screw, for example.

In a still further example, the spring structure 10 may comprise a conical spring, and/or a spring with coils having at least two different distances between coils distances, i.e. differing coil density.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the preceding description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

The invention claimed is:

1. A wind instrument support apparatus, comprising:

an attachment element configured to attach the apparatus to a wind instrument, a spring structure attached to or comprised by the attachment element, and a support bar, wherein the support bar is partially insertable into the spring structure and the apparatus comprises a fastening mechanism configured to selectively fasten the support bar in relation to the spring structure.

2. The apparatus according to claim 1, further comprising a flexible tube inside the spring structure, and the support bar is movable inside the flexible tube.

3. The apparatus according to claim 1, wherein the fastening mechanism comprises a clamping screw and a sleeve connected to the spring structure.

4. The apparatus according to claim 1, wherein the attachment element comprises a channel for receiving the support bar through the spring structure to suppress the flexibility of the attachment element in relation to the support bar.

5. The apparatus according to claim 1, further comprising a rigid support tube and a second spring structure, wherein the support bar is insertable into to the support tube and attachable to the second spring structure to suspend the support bar against the support tube.

6. The apparatus according to claim 1, wherein the attachment element comprises a slot to receiving a mounting ring of the instrument and a clamping device releasably engaging the mounting ring inside the slot.

* * * * *